US010201912B2

(12) United States Patent
Ludovici

(10) Patent No.: US 10,201,912 B2
(45) Date of Patent: Feb. 12, 2019

(54) MANUFACTURING PROCESS OF A STONE PROVIDED WITH LIGHTING FOR FLOORS OR CARRIAGEWAYS

(71) Applicant: LUDOVICI RAFFAELE E FIGLI—S.R.L., Barisciano (AQ) (IT)

(72) Inventor: Alessandro Ludovici, Paganica (IT)

(73) Assignee: LUDOVICI RAFFAELE E FIGLI-S.R.L., Barisciano (AQ) (IT)

( * ) Notice: Subject to any disclaimer, the term of this patent is extended or adjusted under 35 U.S.C. 154(b) by 63 days.

(21) Appl. No.: 15/532,687

(22) PCT Filed: Dec. 20, 2016

(86) PCT No.: PCT/EP2016/082030

§ 371 (c)(1),
(2) Date: Jun. 2, 2017

(87) PCT Pub. No.: WO2017/114698

PCT Pub. Date: Jul. 6, 2017

(65) Prior Publication Data

US 2018/0043571 A1 Feb. 15, 2018

(30) Foreign Application Priority Data

Dec. 29, 2015 (IT) ..... 102015000088804

(51) Int. Cl.

| | |
|---|---|
| ***B28B 3/02*** | (2006.01) |
| ***B28B 15/00*** | (2006.01) |
| ***B28B 23/00*** | (2006.01) |
| ***B30B 11/04*** | (2006.01) |
| ***E04F 13/14*** | (2006.01) |
| *B30B 15/02* | (2006.01) |

(52) U.S. Cl.

CPC ..... *B28B 3/028* (2013.01); *B28B 3/02* (2013.01); *B28B 15/005* (2013.01); *B28B 23/0056* (2013.01); *B30B 11/04* (2013.01); *E04F 13/142* (2013.01); *B28B 3/024* (2013.01); *B30B 15/024* (2013.01)

(58) Field of Classification Search

USPC ..... 264/678

See application file for complete search history.

(56) References Cited

FOREIGN PATENT DOCUMENTS

| | | | |
|---|---|---|---|
| EP | 1454725 | A2 | 9/2004 |
| JP | S60253644 | A | 12/1985 |
| JP | 2011222163 | A | 11/2011 |

OTHER PUBLICATIONS

International Search Report for corresponding International Application No. PCT/EP2016/082030.

*Primary Examiner* — Jacob T Minskey

(74) *Attorney, Agent, or Firm* — Egbert Law Offices, PLLC

(57) ABSTRACT

Manufacturing process of a stone providing for the following steps: positioning a die and a base platform under punches of a press, filling cavities of the die with a sand layer, placing a tube on the sand, actuating the actuation means to actuate the punches from the idle position to the operating position so that each punch presses the tube in the sand and presses the sand in the cavities of the die, actuating the actuation means to raise the punches, placing the stones in a drying station, extracting the solidified sand inside the tube from each stone, and placing a lighting device in the tube.

9 Claims, 5 Drawing Sheets

MANUFACTURING PROCESS OF A STONE PROVIDED WITH LIGHTING FOR FLOORS OR CARRIAGEWAYS

The present patent application for industrial invention relates to a manufacturing process of a stone provided with lighting. The reference sector is the production of stones for floors or road surfaces, in particular of stones comprising a seat to house a lighting device.

Stones comprising a lighting device and a seat obtained inside said stone to house the lighting device are known on the market. The stones are made of pressed sand. More precisely, said stones are made by placing the sand in a die and pressing the sand with a press.

At the end of the pressing operation, the stones are placed in a drying station where they solidify and harden.

Once they are solid, the stones are worked individually in order to obtain the seat used to house the lighting device. The seat is obtained manually by drilling the hardened stone with a tool.

Such a seat making process is time consuming and completely manual.

Said stones must be manually worked by specialized operators that must be able to work the stone and make the seat without damaging the stone.

In fact, when making the seat, pressure is exerted from the interior towards the exterior of the stone, with the risk of cracking the stone. It is not easy for the operator to drill the stone without cracking or damaging it.

At the same time, such a type of manual work involves a high waste caused by mistakes made by the operator when drilling the stone. In fact, once it is damaged or drilled incorrectly, the stone cannot be reused.

Moreover, the hole cannot be drilled near a lateral edge of the stone because, when drilling in proximity of the lateral edge, the stone may crack or crumble due to the high pressure exerted by the tool. In fact, if the distance between the hole and the ending edge of the stone is short, the stone cannot withstand the pressure exerted by the tool during drilling. Consequently, the stone is damaged and useless.

Likewise, small stones cannot be drilled given the fact that, because of their small dimensions, no sufficient space is available to make a hole in the stone at a distance from the lateral edge that prevents the stone from being damaged and/or crushed.

Moreover, since the stones are drilled manually, there is no guarantee that the stones will be identical. It must be noted that the bigger problems are encountered when the drilling operation is made for the same batch of stones by different operators with different experience level and/or working technique.

In view of the above, it can be stated that the stones obtained with such a process have a high cost caused by the aforementioned manual process, by the stones that are wasted after manual drilling and by the long execution time.

EP1454725 discloses a method for manufacturing ceramic pieces with perforations. Such method provides for pressing wet powder to obtain a flat body that is successively dried and fired in order to obtain the final ceramic piece. The pressing of the wet powder provides for perforating one or more holes in the wet powder in order to obtain one or more through perforations in the flat body from which the final ceramic piece is obtained.

JP2011222163 discloses a method for making a decorative panel that provides for pouring cement in a mold containing translucent material and a casing for a light emitting device.

JPS60253644 discloses a manufacturing method of a cement stone comprising light emitting devices.

The purpose of the present invention is to overcome the drawbacks of the prior art by disclosing a process for manufacturing a stone provided with a lighting device, which is inexpensive, rapid, effective and permits to obtain identical stones without cracking or crushing the stones.

The manufacturing process of a stone according to the present invention provides for the following steps:

a) providing a base platform (3);

b) providing a horizontal die comprising a set of through cavities in along a vertical axis;

c) providing a press comprising a punch for every cavity; said press comprising high-low actuation means for simultaneously actuating all punches; said actuation means being configured in such manner to actuate each punch from an idle position, wherein each punch is raised with respect to the die, to an operating position, wherein each punch is lowered and exactly inserted in the cavity in order to press the material contained in the cavity of the die;

d) actuating the actuation means so that the punches are in idle position;

e) positioning the die under the punches in such manner that each cavity of the die is surmounted by a punch;

f) actuating the base platform in such manner to place it under the die; said die being positioned on said base platform so that all cavities are closed in lower position by said base platform;

g) filling the cavities of the die with a sand layer;

h) placing a tube on the sand; said tube having a height equal to or lower than the depth of the cavity and being provided with a longitudinal hole, a lower mouth directed downwards and an upper mouth directed towards the punch;

i) actuating the actuation means to actuate the punches from idle position to operating position so that each punch presses the tube inside the sand and at the same time presses the sand inside each cavity of the die; said stones being provided with an upper surface directed upwards and a lower surface directed downwards; said tube being inserted inside the stone with the upper mouth flush with the upper surface of the stone;

j) actuating the actuation means to raise the punches and bring them back to idle position;

k) raising the die upwards so that all stones are placed on the base platform;

l) placing the stones, which are arranged on the base platform, in a drying station to let the stones solidify;

m) extracting the solidified sand inside the tube from each stone so that the longitudinal hole of the tube is free;

n) placing a lighting device in the longitudinal hole of the tube.

For the sake of clarity, the description of the process according to the invention continues with reference to the attached drawings, which is have a merely illustrative, not limiting value, wherein.

Figure 1:
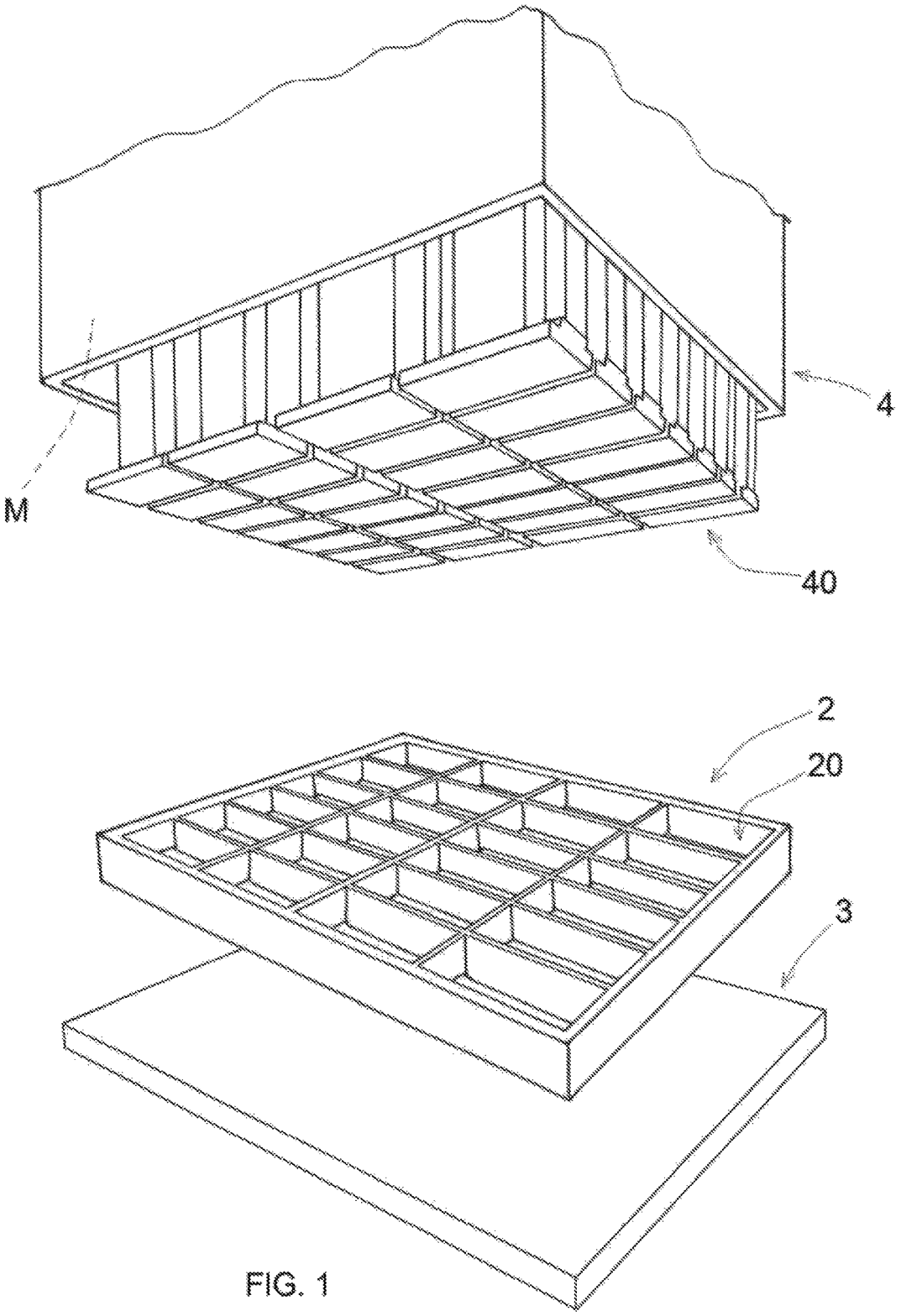
FIG. 1 is a perspective view of a press, a die and a base platform, wherein the die is raised from the base platform.

As shown in FIG. 1, the manufacturing process of stone (1) provided with a lighting device comprises the provision of:

- a base platform (3) with a parallelepiped shape;
- a horizontal die (2) with a parallelepiped shape and dimensions that are lower than or equal to the ones of the base platform (3) and comprises a set of through cavities (20) along a vertical axis; each cavity (20) of the die (2) has a substantially parallelepiped shape and the stone (1) obtained with such process has the same parallelepiped shape as the cavity (20) of the die (2);
- a press (4) comprising a punch (40) for each cavity (20) of the die (2).

The press (4) comprises high-low actuation means (M) for simultaneously actuating all punches (40). The actuation means are configured in such manner to actuate each punch (40) from an idle position, wherein each punch (40) is raised with respect to the die (2), to an operating position, wherein each punch (40) is lowered and exactly inserted in the cavity (20) in order to press the material contained inside the cavity (20) of the die (2).

The press (4) is a vibrating press in such a way to press and at the same time uniformly distribute the material inside each cavity (20) of the die (2). This means that, every time the actuation means are actuated to actuate the punches (40) of the press (4) from idle position to the operating position, said punches (40) are put into vibration.

The actuation means (M) are actuated in such manner that the punches (40) are in idle position.

The die (2) is disposed under the punches (40) of the press (4), in such manner that each cavity (20) of the die (2) is surmounted and aligned with a punch (40) of the press (4).

Figure 2:
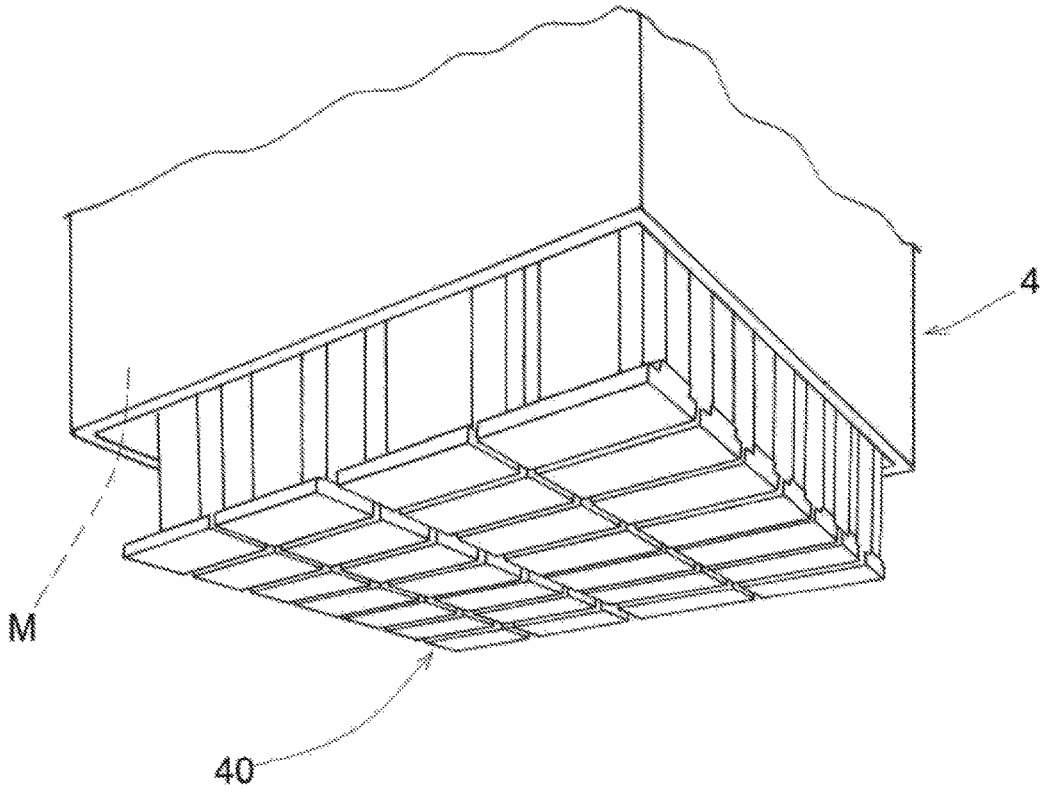
FIG. 2 is a perspective view of the press, the die and the base platform of FIG. 1, wherein the die is disposed on the base platform.
Figure 2:
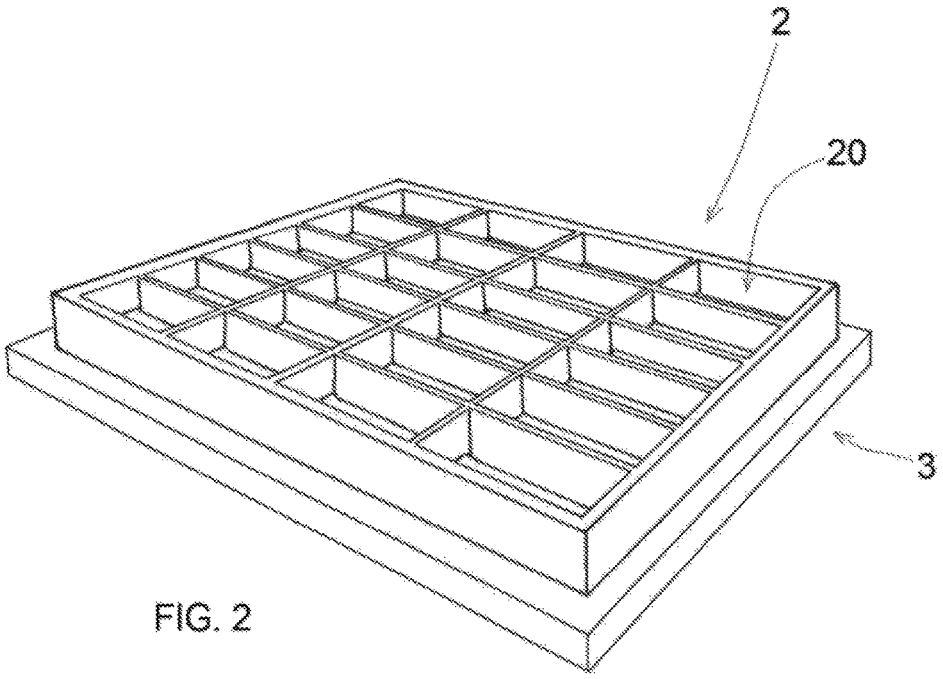

The base platform (3) is actuated by means of actuation means intended to dispose the base platform (3) under the die (2); said actuation means are preferably a conveyor belt whereon said base platform (3) is placed. Therefore the die (2) is placed on the base platform (3), as shown in FIG. 2. In such a way all cavities (20) of the die (2) are closed in lower position by the base platform (3).

Generally, said stones (1) comprise a first pressed sand layer (10) and a second pressed sand layer (11).

Figure 3:
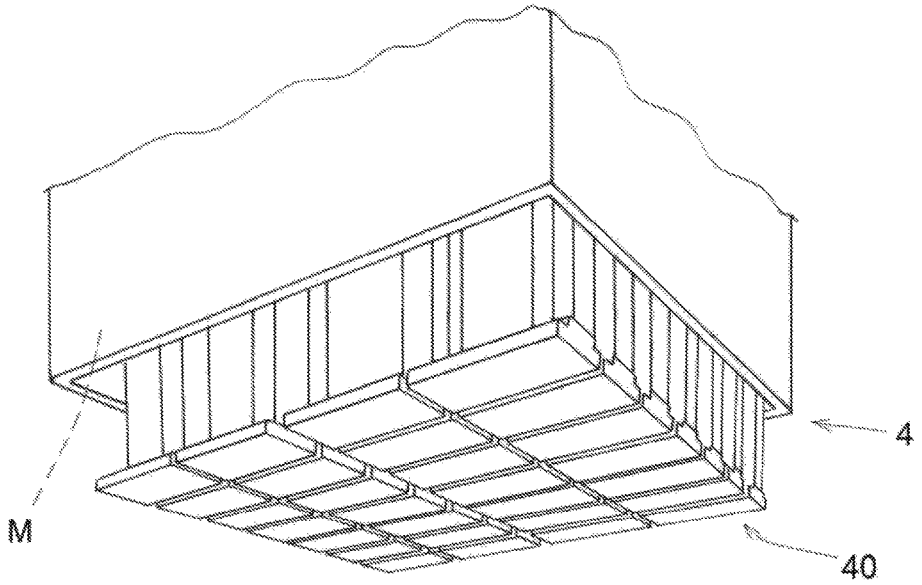
FIG. 3 is a perspective view of the press, the die and the base platform of FIG. 2, wherein the sand is inserted in cavities of the die.
Figure 3:
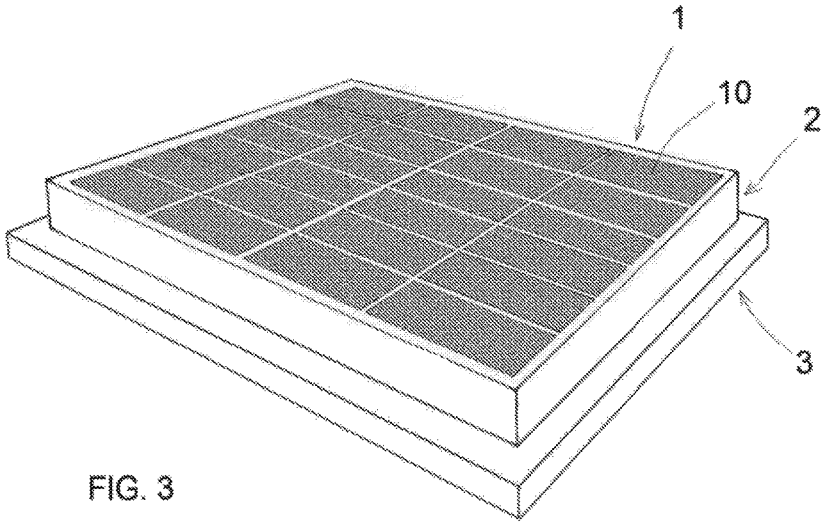

According to the manufacturing process of said stones, each cavity (20) of the die (2) is filled with a first sand layer (10), as shown in FIG. 3.

The actuation means (M) are actuated to actuate the punches (40) from idle position to operating position, in order to press the first sand layer (10) inside each cavity (20) of the die (2).

The actuation means (M) are actuated in such manner to raise the punches (40) and bring them back to idle position.

Figure 4:
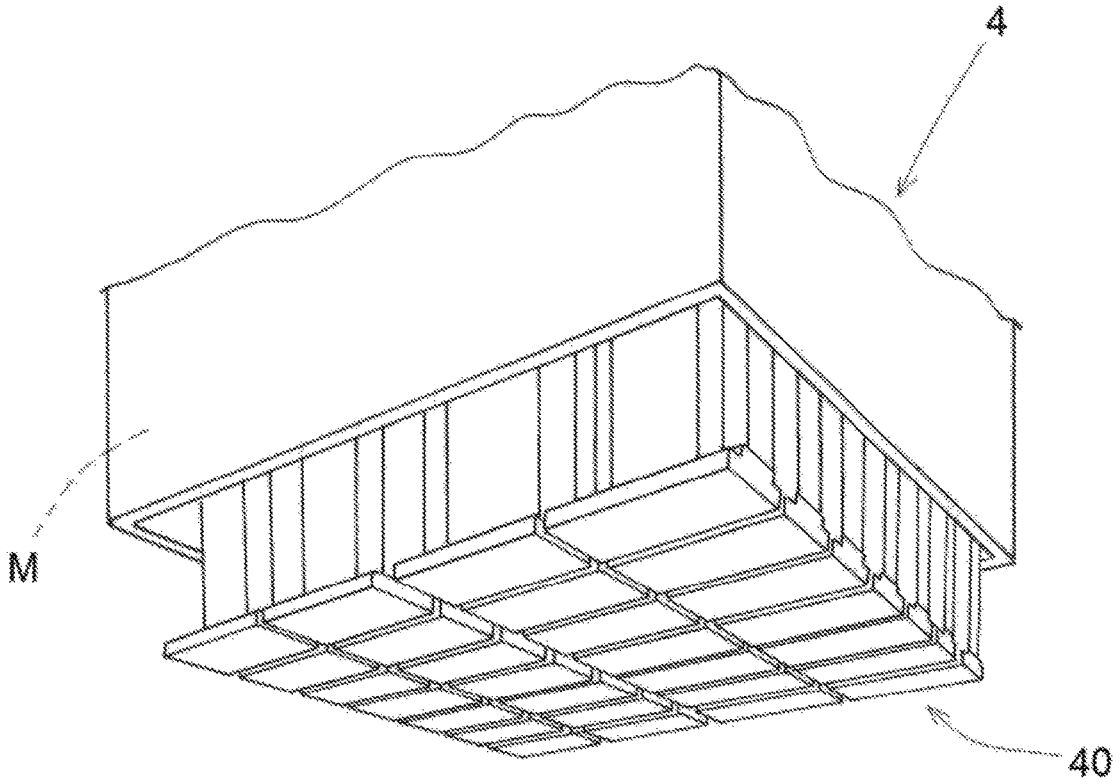
FIG. 4 is a perspective view of the press, the die and the base platform of FIG. 3, wherein a tube is inserted in the sand.
Figure 4:
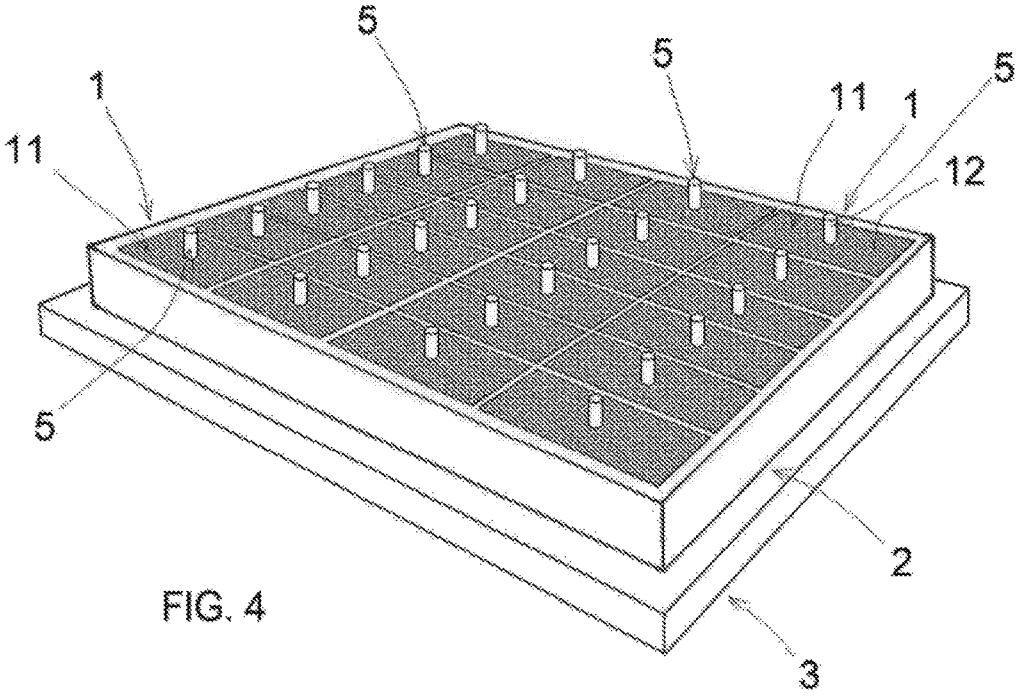

A second sand layer (11) is poured in each cavity (20) of the die (2) onto the first pressed sand layer (10), as shown in FIG. 4.

Therefore, the first sand layer (10) is concealed by the second sand layer (11), and consequently, non-colored cheap sand can be used for the first sand layer (10). Instead, the second sand layer (11) remains visible and consequently said second sand layer (11) is usually made with colored and/or more refined sand compared to the sand of the first sand layer (11).

Moreover, a metal tube (5) is placed in each cavity (20) onto the second sand layer (11) to obtain a seat for a lighting device.

Each tube (5) can be manually placed on the sand, meaning that the tube (5) is placed on the sand by an operator in charge of placing the tube in the desired position on the sand. Evidently, the operator can make mistakes when placing the tube (5) on the sand. For example, it is not guaranteed that the tube in a cavity (20) of the die (2) is in the same position as the tube (5) in another cavity (20) of the die (2). Moreover, the manual execution of said operation is time consuming.

Advantageously, the tube (5) can be placed on the sand with automatic means that are intended to place all tubes (5) in the same position with respect to the stone (1). In this way, identical stones (1) can be obtained and the manufacturing time of the stone (1) can be reduced.

The tube (5) is placed with its longitudinal axis in vertical position.

Figures 5, 6, 7, 8:
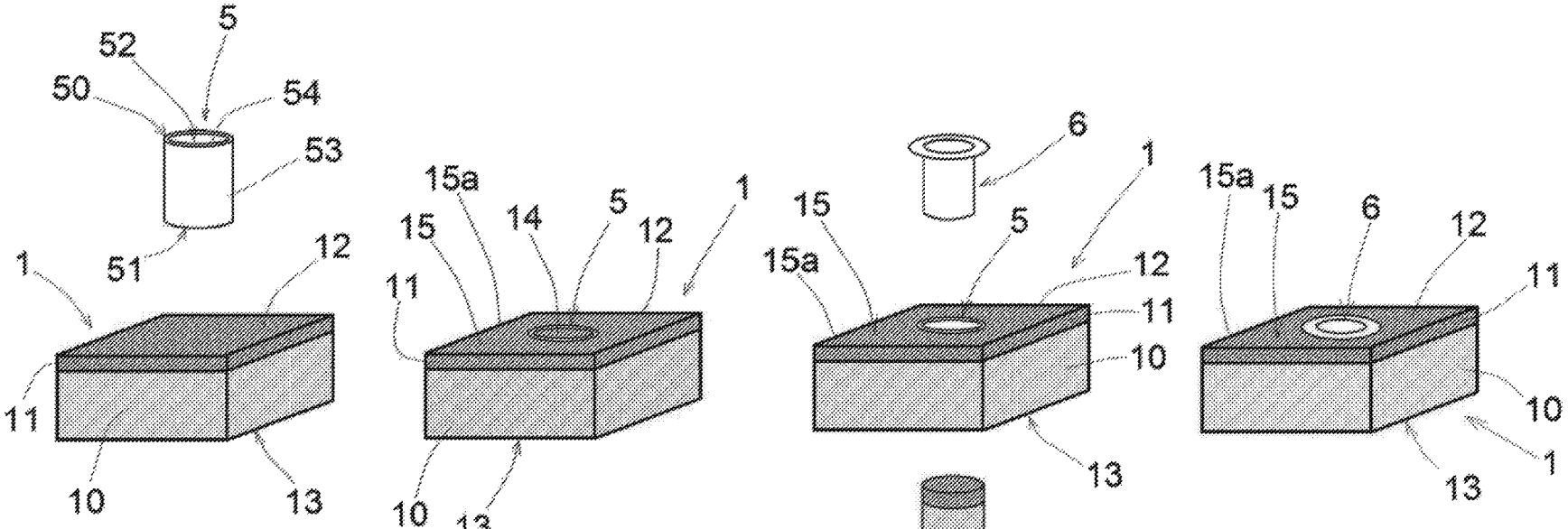
FIG. 5 is an axonometric view of a stone and of the tube.
FIG. 6 is an axonometric view of the stone and of the tube inserted in the stone.
FIG. 7 is an exploded axonometric view showing the stone with the inserted tube, a lighting device and a central portion of the stone, extracted from the stone.
FIG. 8 is an axonometric view of the stone and of the lighting device inserted in the stone.

As shown in FIG. 5, the height of the tube (5) is lower than or equal to the depth of the cavity (20) and the tube (5) has a longitudinal hole (52) that can be accessed through a lower mouth (51) and an upper mouth (50). Moreover, the tube (5) comprises an external wall (53) and an internal wall (54) that defines the longitudinal hole (52).

The tube (5) is placed on the second sand layer (11) in such manner that its upper mouth (50) is directed towards the punch (40) and its lower mouth (51) is directed downwards.

The actuation means (M) are actuated to actuate the punches (40) from idle position to operating position, so that each punch (40) presses the tube (5) inside the first and the second sand layer (10, 11), pressing at the same time also the second sand layer (11) inside each cavity (20) and obtaining the stones (1).

As shown in FIGS. 5 to 8, the stone (1) has an upper surface (12) that is directed upwards and a lower surface (13) that is directed downwards. Considering that the tube (5) is inserted inside the stone (1), the stone (1) comprises:

- a central portion (14) disposed inside the tube (5) and in contact with the internal wall (54) of the tube (5);
- a perimeter portion (15) in contact with the external wall (53) of the tube (5) and provided with a perimeter external lateral edge (15*a*).

The tube (5) is inserted inside the stone (1) with its upper mouth (50) flush with the upper surface (12) of the stone (1).

If the height of the tube (5) is equal to the depth of the cavity (20) of the die (2), each punch (40) pushes the tube (5) in the first and in the second sand layer (10, 11) of each stone (1) until the lower mouth (51) of the tube (5) is placed against the base platform (3) and is flush with the lower surface (13) of the stone (1).

The actuation means (M) are actuated in such manner to raise the punches (40) and bring them back to idle position.

The die (2) is raised upwards so that all stones (1) are placed on the base platform (3).

The stones (1), which are arranged on the base platform (3), are placed in a drying station to solidify. The stones (1) must remain in the drying station for at least 2 days.

The central portion (14) of each stone (1), which is made of sand that has solidified inside the tube (5), is individually extracted from each tube (5) so that the longitudinal hole (52) of the tube (5) is free.

More precisely, the central portion (14) of the stone is extracted from the longitudinal hole (52) of the tube (5) by means of a chisel with an enlarged head having a diameter that is lower than or equal to the one of the upper mouth (50) of the tube.

A lighting device (6) is placed in the longitudinal hole (52) of the tube (5).

The lighting device (6) can be powered with a battery that is inserted in the longitudinal hole (52) of the tube (5) or with an electrical cable. In such a case, the lower mouth (51) of the tube (5) must be free to let the electrical cable out.

In order to ensure the stable anchoring of the tube (5) in the stone (1), one or more protuberances can be provided on the external wall (53) of the tube (5); while said protuberances do not hinder the penetration of the tube (5) inside the sand of the stone (1) under the action exerted by the punch (40) of the press (4), when the sand is solid, said protuberances guarantee the stable anchoring of the tube (5) to the stone (1).

The advantages of the manufacturing process of the invention are evident, according to which the seat for the lighting device is obtained during the manufacturing steps of the stone (1). In this way, it is no longer necessary to drill the stone (1) after its solidification, with the risk of damaging the stone, as in the manufacturing process of the prior art. Consequently, waste is lower compared to the process of the prior art.

Moreover, stones (1) with identical seats can be obtained because the seats are made by pressing the tube (5) in the first and in the second sand layer (10, 11), and not manually.

The manufacturing time of the stone (1) is reduced because the seat is obtained while pressing the sand layers (10, 11), and not manually by drilling each individual stone.

By using the automatic means for positioning the tubes (5), the tubes (5) is always placed in the same position with respect to the stone (1) in such manner to obtain identical stones (1).

Although the aforesaid process provides for manufacturing the stone (1) by pressing a first and a second sand layer (10, 11), such stone (1) can be also manufactured by filling the cavities (20) of the die (2) with one single sand layer and placing the tube (5) onto said single sand layer. The tube (5) is pushed in the sand by means of the punches (40) of the press (4), which simultaneously press the sand layer.

Likewise, the stone (1) can be manufactured with more than two sand layers. In such a case, a sand layer is cyclically poured inside the cavity (20) of the die (2) and the actuation means of the punches (40) of the press (4) are actuated in such manner to press the sand layer. When the last sand layer is poured in the cavity (20) of the die (2), the tube (5) is placed on said last sand layer and the actuation means are actuated to actuate the punches (40) of the press (4) from idle position to operating position in order to push the tube (5) in the sand and press the last sand layer.

Although reference is made to a die (2) comprising cavities (20) with a rectangular shape, said cavities (20) can have a different shape, either a geometrical (for example triangular, square, pentagonal, etc.) or an irregular shape.

While reference is made to sand stones, said stones may comprise different materials, such as cement, gravel, resin and the like.

The invention claimed is:

1. Manufacturing process of a stone comprising the following steps:

a) providing a base platform;

b) providing a horizontal die comprising a series of through cavities along a vertical axis;

c) providing a press with a punch for every cavity of the die; said press comprising actuation means for a simultaneous actuation of all punches; said actuation means being configured in such manner to actuate each punch from an idle position, wherein each punch is raised with respect to the die, to an operating position, wherein each punch is lowered and inserted in the cavity in order to press the material contained in the cavity of the die, d) actuating the actuation means so that the punches are in idle position;

e) positioning the die under the punches in such manner that each cavity of the die is surmounted by a punch;

f) actuating the base platform in such manner to place the base platform under the die; said die being positioned on said base platform so that all cavities of the die are closed in lower position by said base platform;

g) filling the cavities of the die with a sand layer;

h) placing a tube on the sand; said tube having a height equal to or lower than the depth of the cavity and said tube being provided with a longitudinal hole, a lower mouth directed downwards and an upper mouth directed towards the punch;

i) actuating the actuation means to actuate the punches from the idle position to the operating position, so that each punch presses the tube in the sand and simultaneously presses the sand inside each cavity of the die; said stones being provided with an upper surface directed upwards and a lower surface directed downwards; said tube being inserted in the stone with the upper mouth of the tube flush with the upper surface of the stone;

j) actuating the actuation means to raise the punches and bring the pounces back to the idle position;

k) raising the die upwards so that all stones are placed on the base platform (3);

l) placing the stones, which are arranged on the base platform, in a drying station in order to let all stones solidify;

m) extracting the solidified sand inside the tube from each stone so that the longitudinal hole of the tube is free;

n) placing a lighting device in the longitudinal hole of the tube.

2. The process of claim 1, wherein step m) provides for extracting said solidified sand by means of a chisel with enlarged head having a diameter equal to or lower than the upper mouth of the tube.

3. The process of claim 1, wherein step l) provides for the stones to remain in the drying station for at least 2 days.

4. The process of claim 1, wherein step h) provides that the tubes are placed on said sand layer, with automatic means in order to obtain identical stones.

5. The process of claim 1, wherein step i) provides that, if the height of the tube is equal to the depth of the cavity of the die, each punch pushes the tube in the sand layer of each stone until the lower mouth of the tube is flush with the lower surface of the stone.

6. The process of claim 1, wherein step f) provides that the base platform is placed under the die with a conveyor belt.

7. The process of claim 1, wherein, before step h), the tube is provided with one or more protuberances on the external side of the tube in order to guarantee a firm anchoring of the tube in the stone.

8. The process of claim 1, wherein, before step g), a sand layer is cyclically poured inside the cavity of the die and the actuation means of the punches of the press are actuated in such manner to press said sand layer.

9. The process of claim 1, wherein the press is a vibrating press so that said punches are put into vibration when the punches go from idle position to operating position.

* * * * *